US011367975B2

(12) United States Patent
Xu et al.

(10) Patent No.: US 11,367,975 B2
(45) Date of Patent: Jun. 21, 2022

(54) ELECTRICAL CONNECTOR WITH SHORT CIRCUIT PREVENTION FEATURES

(71) Applicant: DONGGUAN LEADER PRECISION INDUSTRY CO., LTD., Dongguan (CN)

(72) Inventors: Hongqiang Xu, Dongguan (CN); Lijun Xu, Dongguan (CN)

(73) Assignee: DONGGUAN LEADER PRECISION INDUSTRY CO., LTD., Dongguan (CN)

( * ) Notice: Subject to any disclaimer, the term of this patent is extended or adjusted under 35 U.S.C. 154(b) by 37 days.

(21) Appl. No.: 17/076,262

(22) Filed: Oct. 21, 2020

(65) Prior Publication Data

US 2021/0143571 A1 May 13, 2021

(30) Foreign Application Priority Data

Nov. 11, 2019 (CN) ..... 201921937689.5

(51) Int. Cl.

| | |
|---|---|
| ***H01R 13/405*** | (2006.01) |
| ***H01R 24/62*** | (2011.01) |
| ***H01R 13/6584*** | (2011.01) |
| ***H01R 13/516*** | (2006.01) |
| *H01R 107/00* | (2006.01) |

(52) U.S. Cl.

CPC ..... *H01R 13/405* (2013.01); *H01R 13/516* (2013.01); *H01R 13/6584* (2013.01); *H01R 24/62* (2013.01); *H01R 2107/00* (2013.01)

(58) Field of Classification Search

CPC . H01R 13/405; H01R 13/516; H01R 13/6584
USPC ..... 439/668
See application file for complete search history.

(56) References Cited

U.S. PATENT DOCUMENTS

| | | | | |
|---|---|---|---|---|
| 10,333,253 | B2 * | 6/2019 | Zhao | H01R 13/405 |
| 10,340,622 | B2 * | 7/2019 | Jo | H04B 1/3888 |
| 10,367,293 | B1 * | 7/2019 | Ono | H01R 13/6582 |
| 10,944,229 | B2 * | 3/2021 | Su | H01R 13/6585 |
| 2015/0155661 | A1 * | 6/2015 | Chen | H01R 13/6582 439/607.01 |
| 2017/0214193 | A1 * | 7/2017 | Tsai | H01R 13/658 |
| 2018/0205180 | A1 * | 7/2018 | Zhao | H01R 43/24 |
| 2018/0287290 | A1 * | 10/2018 | Kifune | H01R 13/504 |

* cited by examiner

*Primary Examiner* — Alexander Gilman
(74) *Attorney, Agent, or Firm* — Birch, Stewart, Kolasch & Birch, LLP

(57) ABSTRACT

The present disclosure an electrical connector having an insulating body and a number of conductive terminals. The insulating body includes a base portion and an extension portion. The extension portion includes a first surface and a second surface. The conductive terminals include a number of first contact portions located on a same side of the first surface and a number of second contact portions located on a same side of the second surface. At least part of surfaces of the first contact portions do not protrude beyond the first surface. At least part of surfaces of the second contact portions do not protrude beyond the second surface. As a result, the electrical connector of the present disclosure can avoid a short circuit problem between adjacent conductive terminals due to accumulation of a certain degree of dirt.

17 Claims, 11 Drawing Sheets

ELECTRICAL CONNECTOR WITH SHORT CIRCUIT PREVENTION FEATURES

CROSS-REFERENCE TO RELATED APPLICATION

This patent application claims priority of a Chinese Patent Application No. 201921937689.5, filed on Nov. 11, 2019 and titled "ELECTRICAL CONNECTOR", the entire content of which is incorporated herein by reference.

TECHNICAL FIELD

The present disclosure relates to an electrical connector, which belongs to a technical field of connectors.

BACKGROUND

An existing electrical connector (such as a Type C male connector) usually includes a tongue and a plurality of conductive terminals exposed on a surface of the tongue. Surfaces of the conductive terminals are higher than the surface of the tongue due to process and other reasons. This structure will accumulate dirt continuously during long-term use of the product, and the adjacent conductive terminals will generate micro currents, which is prone to short circuit risks.

SUMMARY

An object of the present disclosure is to provide an electrical connector which is unlikely to occur short-circuit between conductive terminals.

In order to achieve the above object, the present disclosure adopts the following technical solution: an electrical connector comprising an insulating body and a plurality of conductive terminals fixed to the insulating body. The insulating body includes a tongue. The tongue includes a base portion and an extension portion protruding from the base portion. The base portion and the extension portion jointly form a stepped surface. The extension portion includes a first surface and a second surface opposite to the first surface. The plurality of conductive terminals include a plurality of first contact portions located on a same side of the first surface and a plurality of second contact portions located on a same side of the second surface. At least part of surfaces of the first contact portions do not protrude beyond the first surface of the extension portion which is located between two adjacent first contact portions. At least part of surfaces of the second contact portions do not protrude beyond the second surface of the extension portion which is located between two adjacent second contact portions.

Compared with the prior art, the present disclosure sets the surfaces of the first contact portions and the second contact portions not to protrude beyond a corresponding surface of the tongue so as to avoid the problem of short circuit between the conductive terminals due to accumulation of a certain degree of dirt.

DETAILED DESCRIPTION

Figure 1:
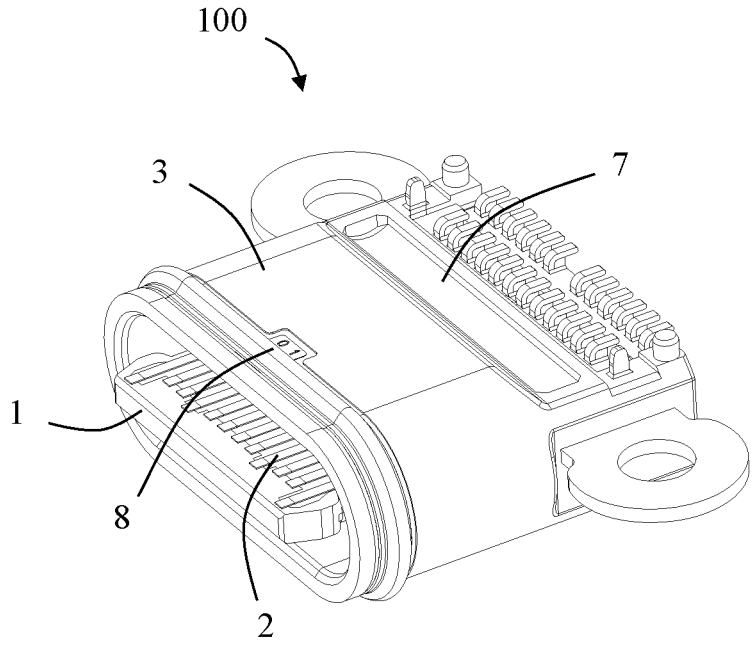
FIG. 1 is a perspective view of an electrical connector in accordance with a first embodiment of the present disclosure.
Figure 2:
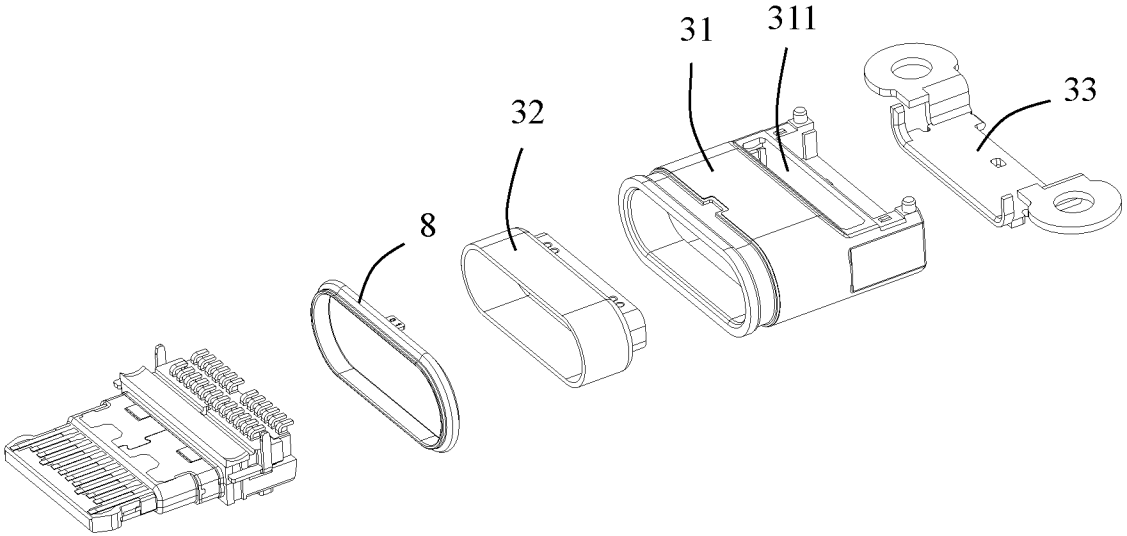
FIG. 2 is a partially exploded perspective view of FIG. 1.

Referring to FIGS. 1 to 6, the present disclosure discloses an electrical connector 100 which includes an insulating body 1, a plurality of conductive terminals 2 located on the insulating body 1, and a shielding shell 3 enclosing the insulating body 1. Referring to FIG. 2, in the illustrated embodiment of the present disclosure, the shielding shell 3 includes an outer shell 31, an inner shell 32 and a rear shell 33. In the illustrated embodiment of the present disclosure, the electrical connector 100 is a Type C receptacle connector which is used to be mounted on a circuit board (not shown).

Figure 3:
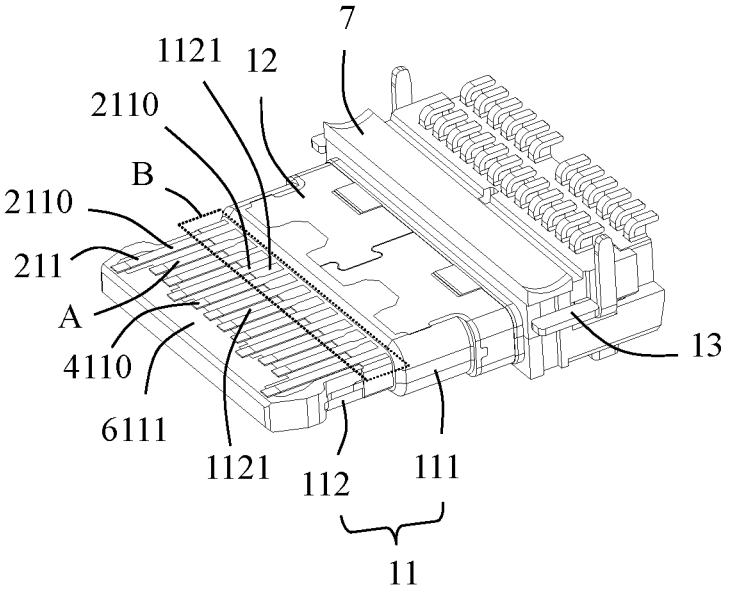
FIG. 3 is a perspective schematic view after removing a shielding shell in FIG. 1.

Referring to FIG. 3, the insulating body 1 is provided with a tongue 11, a shielding cover 12 formed on the tongue 11, and a shielding piece 13 insert-molded with the insulating body 1. The tongue 11 includes a base portion 111 and an extension portion 112 protruding from the base portion 111. The base portion 111 and the extension portion 112 jointly form a stepped surface. The shielding cover 12 encloses the base portion 111 so as to reduce signal transmission interference of the conductive terminals 2. In the illustrated embodiment of the present disclosure, a surface of the extension portion 112 is lower than a corresponding surface of the base portion 111, thereby jointly forming the stepped surface.

Figure 4:
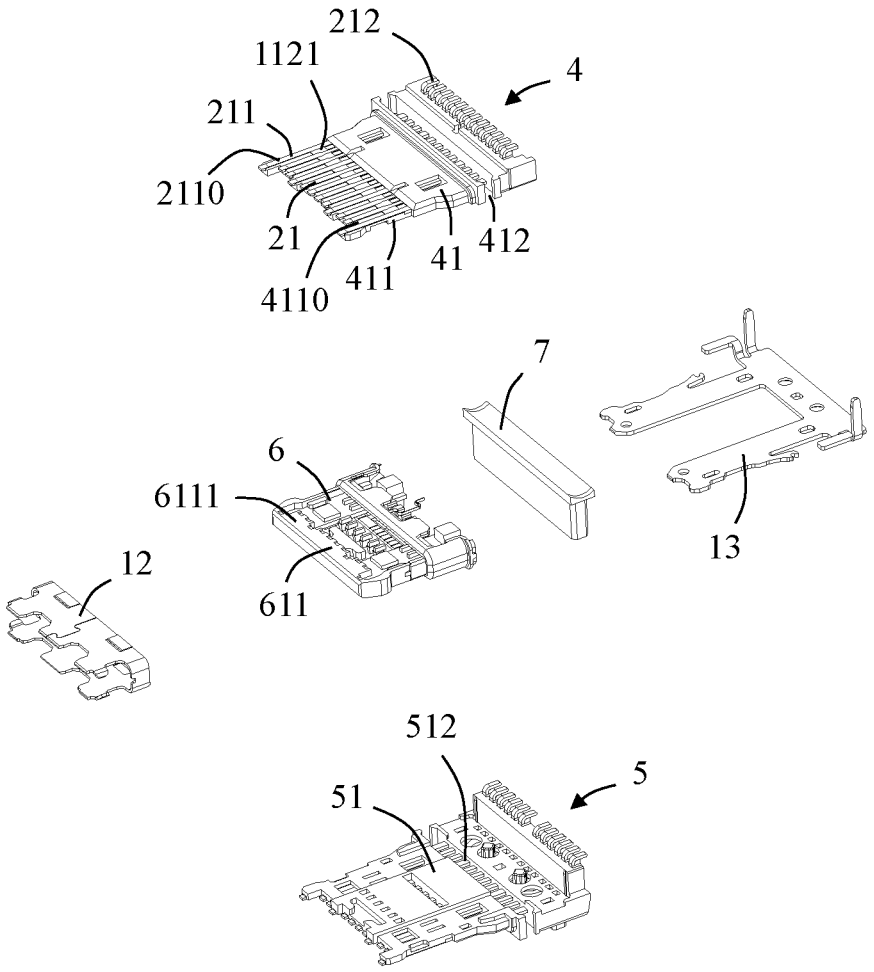
FIG. 4 is an exploded perspective view of FIG. 3.
Figure 5:
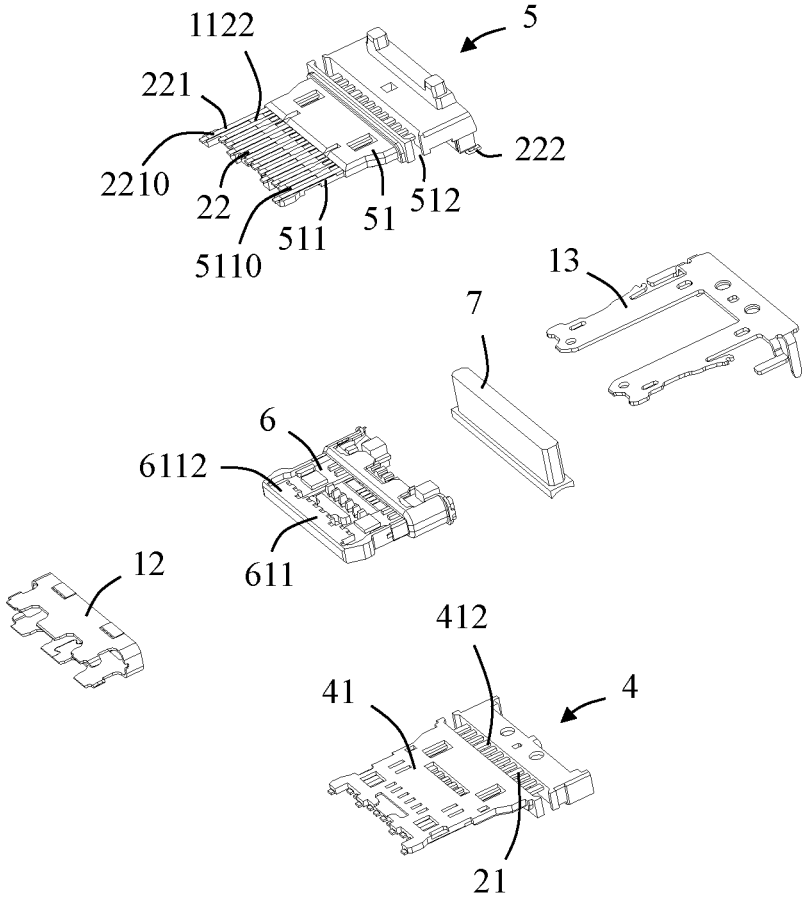
FIG. 5 is an exploded perspective view of FIG. 4 from another angle.
Figure 6:
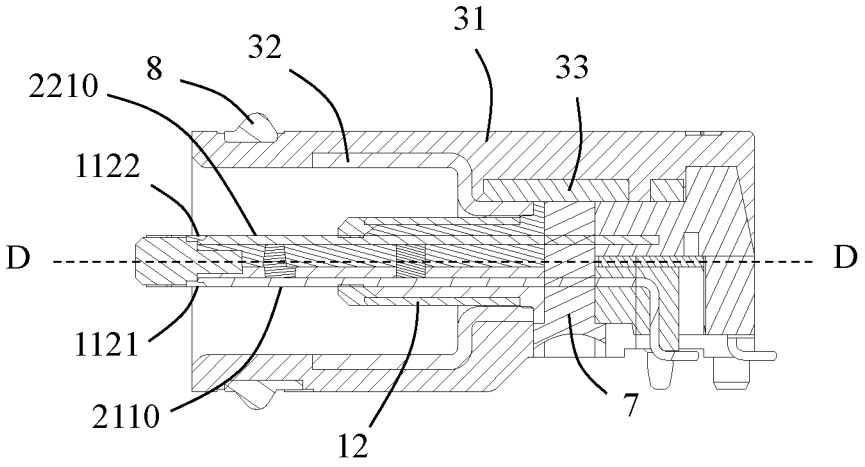
FIG. 6 is a schematic cross-sectional view of FIG. 1.
Figure 7:
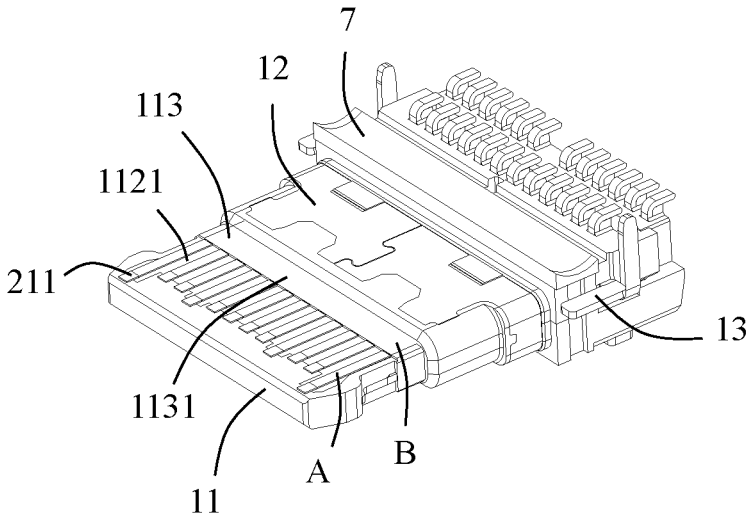
FIG. 7 is a perspective schematic view of an electrical connector in accordance with another embodiment of the present disclosure with a shielding shell removed.
Figure 8:
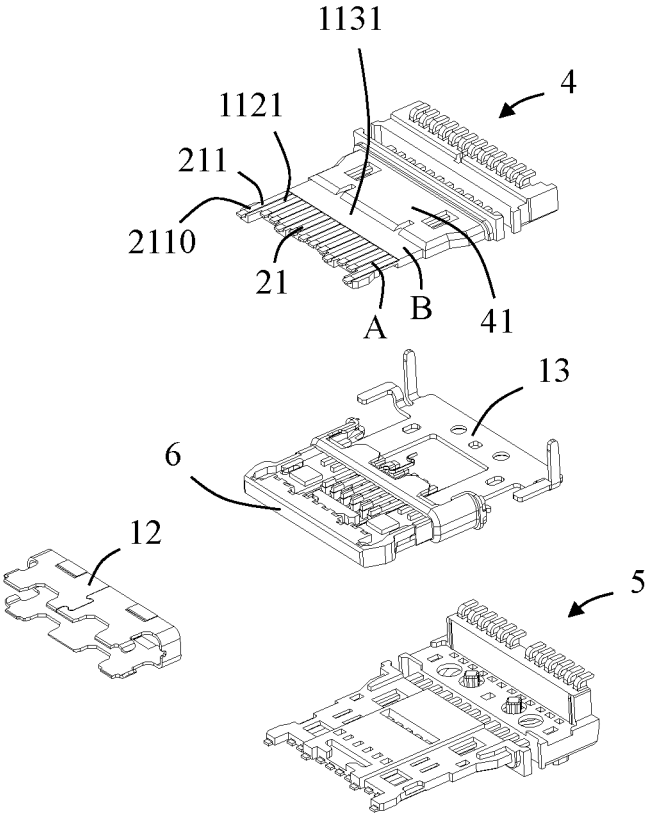
FIG. 8 is an exploded perspective view of FIG. 7.
Figure 9:
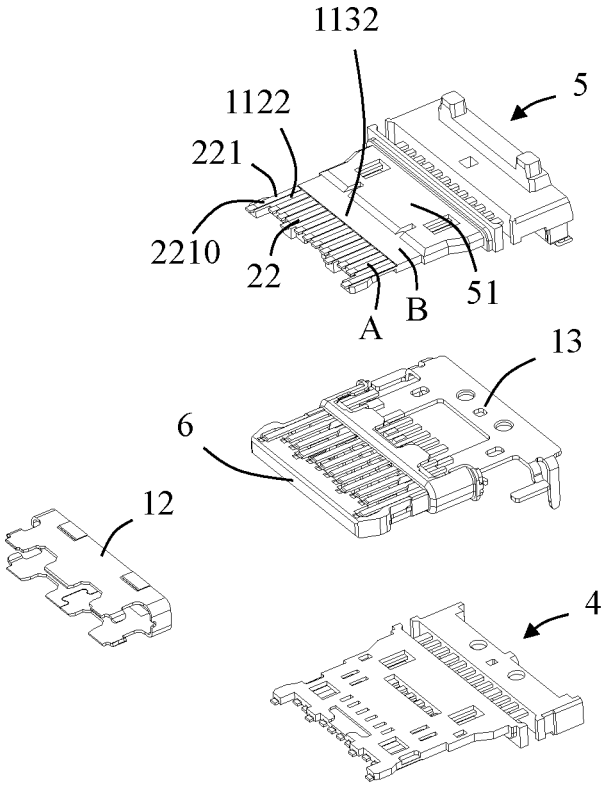
FIG. 9 is an exploded perspective view of FIG. 8 from another angle.
Figure 10:
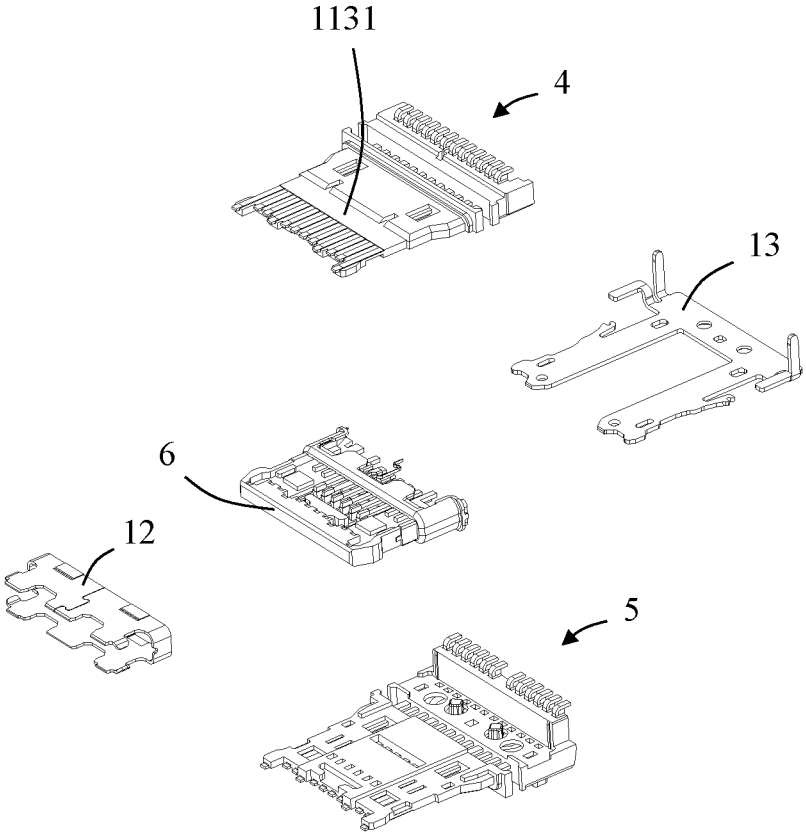
FIG. 10 is a further perspective exploded view of FIG. 8.
Figure 11:
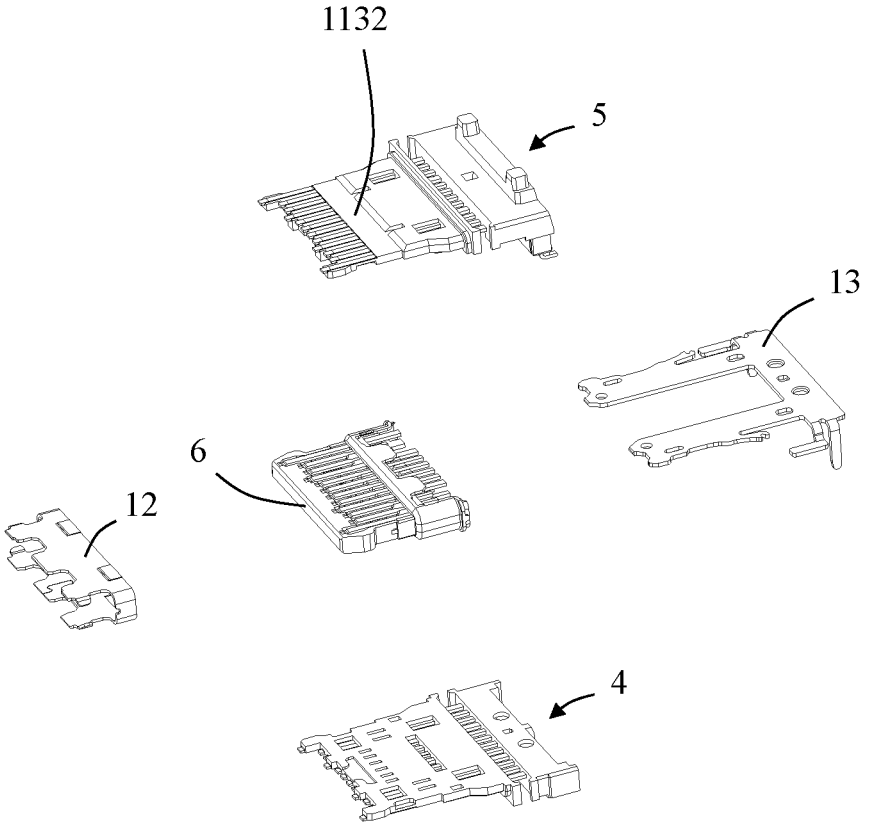
FIG. 11 is an exploded perspective view of FIG. 10 from another angle.

Referring to FIGS. 4 and 5, the extension portion 112 includes a first surface 1121 and a second surface 1122 opposite to the first surface 1121. In the illustrated embodiment of the present disclosure, the first surface 1121 is a lower surface, and the second surface 1122 is an upper surface.

The plurality of conductive terminals 2 include a plurality of first contact portions 211 located on a same side of the first surface 1121 and a plurality of second contact portions 221 located on a same side of the second surface 1122. The first contact portions 211 and the second contact portions 221 are provided with a mating area A for being inserted into a mating connector and a non-mating area B which does not extend into the mating connector. At least part of surfaces 2110 of the first contact portions 211 do not protrude beyond the first surface 1121 of the extension portion 112 between two adjacent first contact portions 211. At least part of surfaces 2210 of the second contact portions 221 do not protrude beyond the second surface 1122 of the extension portion 112 located between two adjacent second contact portions 221. In the illustrated embodiment of the present disclosure, each of the first contact portions 211 is of a flat plate configuration, and the surfaces 2110 of the first contact portions 211 located in the non-mating area B do not protrude beyond the first surface 1121 located in the non-mating area B. Each of the second contact portions 221 is of a flat plate configuration, and the surfaces 2210 of the second contact portions 221 located in the non-mating area B do not protrude beyond the second surface 1122 located in the non-mating area B. This arrangement can avoid the problem of easy accumulation of dirt due to the presence of grooves between the contact portions of the adjacent conductive terminals, which will eventually cause a short circuit between the conductive terminals 2.

Referring to FIGS. 1 to 6, in an embodiment of the present disclosure, the surfaces 2110 of the first contact portions 211 located in the non-mating area B are flush with the first surface 1121 located in the non-mating area B. The surfaces 2210 of the second contact portions 221 located in the non-mating area B are flush with the second surface 1122 located in the non-mating area B. With this arrangement, it is possible to better avoid the problem of easy accumulation of dirt due to the presence of the stepped surface, which will eventually cause a short circuit between the conductive terminals 2.

In other embodiments of the present disclosure, the surfaces 2110 of the first contact portions 211 located in the non-mating area B is lower than the first surface 1121 located in the non-mating area B. The surfaces 2210 of the second contact portions 221 located in the non-mating area B is lower than the second surface 1122 located in the non-mating area B. This arrangement can also reduce the problem of short-circuit between the conductive terminals 2 caused by accumulated dirt due to raised insulating portions formed between the contact portions of the adjacent conductive terminals 2 to separate the contact portions.

Specifically, the electrical connector 100 includes a first terminal module 4, a second terminal module 5, and a third insulating body 6 over-molded on the first terminal module 4 and the second terminal module 5.

The first terminal module 4 includes a first insulating body 41 and a plurality of first terminals 21 insert-molded in the first insulating body 41. Each first terminal 21 has a first contact portion 211 and a first soldering portion 212. The first insulating body 41 is provided with a first tongue portion 411 for fixing the first contact portions 211. An upper surface 4110 of the first tongue portion 411 in the mating area A does not protrude beyond the surfaces 2110 of the first contact portions 211 in the mating area A, so as to avoid affecting the electrical contact between the first contact portions 211 and the mating connector. The first insulating body 41 has a first hollow portion 412.

The second terminal module 5 includes a second insulating body 51 and a plurality of second terminals 22 insert-molded in the second insulating body 51. Each second terminal 22 has a second contact portion 221 and a second soldering portion 222. The second insulating body 51 is provided with a second tongue portion 511 for fixing the second contact portions 221. A lower surface 5110 of the second tongue portion 511 located in the mating area A does not protrude beyond the surfaces 2210 of the second contact portions 221 located in the mating area A, so as to avoid affecting the electrical contact between the second contact portions 221 and the mating connector. The second insulating body 51 has a second hollow portion 512.

The third insulating body 6 includes a third tongue portion 611 over-molded on the first tongue portion 411 and the second tongue portion 511. Referring to FIGS. 4 and 5, the third tongue portion 611 has a third surface 6111 and a fourth surface 6112 opposite to the third surface 6111. The third surface 6111 in the mating area A is lower than the first surface 1121 in the mating area A. The fourth surface 6112 located in the mating area A is lower than the second surface 1122 located in the mating area A. It should be noted that in the description of all the specific embodiments of the present disclosure, the descriptions related to "do not protrude beyond", "below" and other related positions are based on the mid-plane D-D of the tongue 11 (see FIG. 6). That is, a position closer to the middle plane D-D is a lower and less protruding position.

In the illustrated embodiment of the present disclosure, the insulating body 1 includes the first insulating body 41, the second insulating body 51 and the third insulating body 6. The extension portion 112 of the tongue 11 includes the first tongue portion 411, the second tongue portion 511 and the third tongue portion 611. The conductive terminals 2 include the first terminals 21 and the second terminals 22.

Referring to FIGS. 2 and 4, the outer shell 31 is provided with a glue filling hole 311 communicating with the first hollow portion 412 and the second hollow portion 512. The electrical connector 100 is provided with a sealant 7 which is injected into the first hollow portion 412 and the second hollow portion 512 from the glue filling hole 311 to achieve sealing. This arrangement improves waterproof performance of the electrical connector 100. In addition, the electrical connector 100 is further provided with a sealing ring 8 sleeved on the outer shell 31 to improve the sealing effect when the electrical connector 100 is mated with the mating connector.

Referring to FIGS. 7 to 11, in another embodiment of the present disclosure, the first contact portions 211 and the second contact portions 221 are provided with a mating area A for being inserted into the mating connector and a non-mating area B unextending into the mating connector. The tongue 11 is provided with a covering portion 113 covering the non-mating area B. This arrangement can fundamentally avoid the short circuit between the conductive terminals 2 due to accumulated dirt.

The covering portion 113 includes a first covering portion 1131 covering the first contact portions 211 located in the non-mating area B and a second covering portion 1132 covering the second contact portions 221 located in the non-mating area B. In the illustrated embodiment of the present disclosure, the first tongue portion 411 is provided with the first covering portion 1131, and the second tongue portion 511 is provided with the second covering portion 1132. Of course, in other embodiments, the first covering portion 1131 and the second covering portion 1132 may also be provided on the third insulating body 6, which can also achieve the objective of the present disclosure.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector, comprising:

an insulating body comprising a tongue, the tongue comprising a base portion and an extension portion protruding from the base portion, the base portion and the extension portion jointly forming a stepped surface, the extension portion comprising a first surface and a second surface opposite to the first surface; and a plurality of conductive terminals fixed to the insulating body, the plurality of conductive terminals comprising a plurality of first contact portions located on a same side of the first surface and a plurality of second contact portions located on a same side of the second surface; wherein at least part of surfaces of the first contact portions do not protrude beyond the first surface of the extension portion which is located between two adjacent first contact portions; wherein at least part of surfaces of the second contact portions do not protrude beyond the second surface of the extension portion which is located between two adjacent second contact portions; wherein the electrical connector comprises a first terminal module and a second terminal module, the first terminal module comprises a first insulating body, the second terminal module comprises a second insulating body, the plurality of conductive terminals comprise a plurality of first terminals fixed in the first insulating body and a plurality of second terminals fixed in the second insulating body; and wherein the electrical connector further comprises a shielding shell enclosing the insulating body, the first insulating body comprises a first hollow portion, the shielding shell comprises a glue filling hole communicating with the first hollow portion, and the electrical connector comprises a sealant injected into the first hollow portion from the glue filling hole to achieve sealing.

2. The electrical connector according to claim 1, wherein the first contact portions and the second contact portions are provided with a mating area for being inserted into a mating connector and a non-mating area which does not extend into the mating connector, the surfaces of the first contact portions located in the non-mating area do not protrude beyond the first surface located in the non-mating area, and the surfaces of the second contact portions located in the non-mating area do not protrude beyond the second surface located in the non-mating area.

3. The electrical connector according to claim 2, wherein the surfaces of the first contact portions located in the non-mating area are flush with the first surface located in the non-mating area, and the surfaces of the second contact portions located in the non-mating area are flush with the second surface located in the non-mating area.

4. The electrical connector according to claim 3, wherein the plurality of first terminals are insert-molded in the first insulating body and the plurality of second terminals are insert-molded in the second insulating body, each of the first terminals has the first contact portion, each of the second terminals has the second contact portion, and both the first contact portions and the second contact portions are of flat plate configurations.

5. The electrical connector according to claim 4, wherein the first insulating body is provided with a first tongue portion for fixing the first contact portions, and an upper surface of the first tongue portion in the mating area does not protrude beyond the surfaces of the first contact portions in the mating area; and wherein the second insulating body is provided with a second tongue portion for fixing the second contact portions, and a lower surface of the second tongue portion in the mating area does not protrude beyond the surfaces of the second contact portions in the mating area; and wherein the extension portion comprises the first tongue portion and the second tongue portion.

6. The electrical connector according to claim 5, further comprising a third insulating body over-molded on the first terminal module and the second terminal module, the extension portion comprising a third tongue portion over-molded on the first tongue portion and the second tongue portion, the third tongue portion comprising a third surface and a fourth surface opposite to the third surface; wherein the third surface located in the mating area is lower than the first surface located in the mating area, and the fourth surface located in the mating area is lower than the second surface located in the mating area.

7. The electrical connector according to claim 6, wherein the first surface located in the mating area is lower than the surfaces of the first contact portions located in the mating area, and the second surface located in the mating area is lower than the surfaces of the second contact portions located in the mating area.

8. The electrical connector according to claim 1, wherein the second insulating body comprises a second hollow portion in communication with the first hollow portion, and the sealant is injected into the first hollow portion and the second hollow portion from the glue filling hole to achieve sealing.

9. The electrical connector according to claim 1, further comprising a sealing ring sleeved on the shielding shell.

10. An electrical connector, comprising:

an insulating body comprising a tongue, the tongue comprising a base portion and an extension portion protruding from the base portion, the extension portion comprising a first surface and a second surface opposite to the first surface; and a plurality of conductive terminals insert-molded with the insulating body, the plurality of conductive terminals comprising a plurality of first contact portions located on a same side of the first surface and a plurality of second contact portions located on a same side of the second surface, the first contact portions and the second contact portions being provided with a mating area for being inserted into a mating connector and a non-mating area which does not extend into the mating connector; wherein the tongue is provided with a covering portion covering the non-mating area so that short circuit between adjacent first contact portions and short circuit between adjacent second contact portions are avoided; wherein the electrical connector comprises a first terminal module and a second terminal module, the first terminal module comprises a first insulating body, the second terminal module comprises a second insulating body, the plurality of conductive terminals comprise a plurality of first terminals fixed in the first insulating body and a plurality of second terminals fixed in the second insulating body; and wherein the electrical connector further comprises a shielding shell enclosing the insulating body, the first insulating body comprises a first hollow portion, the shielding shell comprises a glue filling hole communicating with the first hollow portion, and the electrical connector comprises a sealant injected into the first hollow portion from the glue filling hole to achieve sealing.

11. The electrical connector according to claim 10, wherein the surfaces of the first contact portions located in the non-mating area do not protrude beyond the first surface located in the non-mating area, and the surfaces of the second contact portions located in the non-mating area do not protrude beyond the second surface located in the non-mating area.

12. The electrical connector according to claim 10, wherein the covering portion comprises a first covering portion covering the non-mating area of the first contact portions and a second covering portion covering the non-mating area of the second contact portions.

13. The electrical connector according to claim 10, wherein the plurality of first terminals are insert-molded in the first insulating body and the plurality of second terminals are insert-molded in the second insulating body, each of the first terminal has the first contact portion, each of the second terminal has the second contact portion, and both the first contact portions and the second contact portions are of flat plate configurations.

14. The electrical connector according to claim 13, wherein the first insulating body is provided with a first tongue portion for fixing the first contact portions, and the first tongue portion is provided with the first covering portion; and wherein the second insulating body is provided with a second tongue portion for fixing the second contact portions, and the second tongue portion is provided with the second covering portion.

15. The electrical connector according to claim 14, further comprising a third insulating body over-molded on the first terminal module and the second terminal module, the extension portion comprising a third tongue portion over-molded on the first tongue portion and the second tongue portion.

16. The electrical connector according to claim 10, wherein the second insulating body comprises a second hollow portion in communication with the first hollow portion, and the sealant is injected into the first hollow portion and the second hollow portion from the glue filling hole to achieve sealing.

17. The electrical connector according to claim 10, further comprising a sealing ring sleeved on the shielding shell.

* * * * *